US009071898B2

(12) United States Patent
Cazes Bouchet

(10) Patent No.: US 9,071,898 B2
(45) Date of Patent: Jun. 30, 2015

(54) ACOUSTIC LOUDSPEAKER

(75) Inventor: Arnaud Cazes Bouchet, Balbigny (FR)

(73) Assignee: FOCAL JMLAB, La Talaudiere (FR)

( * ) Notice: Subject to any disclaimer, the term of this patent is extended or adjusted under 35 U.S.C. 154(b) by 48 days.

(21) Appl. No.: 13/699,180

(22) PCT Filed: May 27, 2011

(86) PCT No.: PCT/FR2011/051207

§ 371 (c)(1),
(2), (4) Date: Dec. 12, 2012

(87) PCT Pub. No.: WO2011/148109

PCT Pub. Date: Dec. 1, 2011

(65) Prior Publication Data

US 2013/0064413 A1 Mar. 14, 2013

(30) Foreign Application Priority Data

May 28, 2010 (FR) ..... 10 54130

(51) Int. Cl.

| | |
|---|---|
| ***H04R 9/06*** | (2006.01) |
| ***H04R 9/02*** | (2006.01) |
| ***H04R 7/04*** | (2006.01) |
| ***H04R 7/12*** | (2006.01) |
| ***H04R 7/16*** | (2006.01) |
| ***H04R 9/04*** | (2006.01) |

(52) U.S. Cl.

CPC ..... *H04R 9/025* (2013.01); *H04R 7/04* (2013.01); *H04R 7/12* (2013.01); *H04R 7/16* (2013.01); *H04R 9/04* (2013.01); *H04R 2209/024* (2013.01); *H04R 2231/003* (2013.01); *H04R 2499/13* (2013.01)

(58) Field of Classification Search

CPC ..... H04R 9/025; H04R 2209/021; H04R 2209/022; H02K 41/0354; H02K 41/0356

USPC ..... 381/398, 400, 403, 412, 419, 431; 310/12.16, 12.24–12.26

See application file for complete search history.

(56) References Cited

U.S. PATENT DOCUMENTS 3,567,870 A * 3/1971 Rivera ..... 381/152
3,763,334 A * 10/1973 Parker ..... 381/420
5,267,111 A * 11/1993 Nishimura et al. ..... 360/266.7

(Continued)

FOREIGN PATENT DOCUMENTS

EP 1482762 A2 12/2004
EP 1553802 A2 7/2005

OTHER PUBLICATIONS

European Patent Office, International Search Report for corresponding International Application No. PCT/FR2011/051207, English and French Languages, dated Jul. 27, 2011 (6 pgs).

*Primary Examiner* — Curtis Kuntz
*Assistant Examiner* — Joshua A Kaufman
(74) *Attorney, Agent, or Firm* — Harris Beach PLLC

(57) ABSTRACT

Acoustic loudspeaker comprising: a movable membrane; a source of constant magnetic field, a coil mechanically secured to said membrane and interacting with the magnetic field so as to displace the membrane, when it is traversed by an alternating current, characterized in that the membrane carries the coil at its periphery, and in that the magnetic field source is formed by a set of at least one magnetized element disposed at the periphery of said membrane, around the coil, the magnetic field generated by said at least one magnetized element being in a plane parallel to the membrane.

8 Claims, 2 Drawing Sheets

(56) References Cited

U.S. PATENT DOCUMENTS

| | | | | |
|---|---|---|---|---|
| 5,452,366 | A * | 9/1995 | Sakamoto et al. | 381/422 |
| 5,894,263 | A * | 4/1999 | Shimakawa et al. | 340/388.1 |
| 6,020,805 | A * | 2/2000 | Borja | 336/84 M |
| 6,359,997 | B2 * | 3/2002 | Geisenberger et al. | 381/412 |
| 6,611,606 | B2 * | 8/2003 | Guenther | 381/421 |
| 7,197,155 | B2 * | 3/2007 | Bank | 381/420 |
| 7,317,810 | B2 * | 1/2008 | Ohashi | 381/421 |
| 7,706,563 | B2 * | 4/2010 | Stewart | 381/421 |
| 7,757,376 | B2 * | 7/2010 | Saitou et al. | 29/596 |
| 8,055,010 | B2 * | 11/2011 | Lemarquand et al. | 381/400 |
| 8,571,252 | B2 * | 10/2013 | North et al. | 381/396 |
| 8,923,545 | B2 * | 12/2014 | Servadio | 381/417 |
| 2002/0146145 | A1 | 10/2002 | James et al. | |
| 2004/0213431 | A1 * | 10/2004 | Mello | 381/430 |
| 2005/0179326 | A1 | 8/2005 | Moro | |
| 2006/0091747 | A1 * | 5/2006 | Yamaguchi et al. | 310/81 |
| 2008/0166010 | A1 | 7/2008 | Stiles et al. | |
| 2009/0310813 | A1 | 12/2009 | Sumitani et al. | |
| 2011/0255715 | A1 * | 10/2011 | Doh et al. | 381/162 |

* cited by examiner

ACOUSTIC LOUDSPEAKER

CROSS-REFERENCE TO RELATED APPLICATIONS

This application is a national stage application under 35 U.S.C. §371 of PCT Application No. PCT/FR2011/051207, filed May 27, 2011, which claims priority to and the benefit of French Application No. 1054130 filed on May 28, 2010, which are incorporated herein by reference in its entirety.

BACKGROUND

The present disclosure relates to the field of acoustic loudspeakers, and more specifically of low-bulk loudspeakers. It more specifically relates to a novel architecture of loudspeakers which enables to greatly decrease the thickness thereof, that is, their dimension measured perpendicularly to the sound emission direction.

PRIOR ART

Generally, a loudspeaker comprises a mobile membrane mechanically associated with a winding conducting a current representative of the acoustic signal to be generated. The loudspeaker also comprises a source of a generally constant magnetic field which interacts with the current conducted by the winding to enable to displace the winding, and thus the membrane.

Generally, the winding is arranged in a central area of the membrane which itself has a generally conical shape, between polar elements which enable to channel the magnetic field generated by the magnetic field source, which is itself located under the membrane. It can be understood that the stacking of these different elements is done to the detriment of the general loudspeaker thickness. In other words, when a conventional loudspeaker of decreased thickness is desired to be formed, the membrane cone angle or the dimensions of the magnetic field source have to be decreased, with an inevitable degradation of acoustic performances.

Now, in certain applications, it is necessary for the acoustic sources to be as thin as possible. The integration of loudspeakers in vehicle door or in different pieces of furniture may be mentioned as a non-limiting example.

An example of loudspeaker of limited thickness is described in document EP 1553802. Such a loudspeaker comprises a ring-shaped magnetic assembly arranged at the membrane periphery. This assembly comprises several stacked magnets having magnetizations which are radial for the central layer, and axial for peripheral layers. Such a layout enables to concentrate field lines towards the inside of the ring formed by the magnetic assembly, but has the major disadvantage of limiting the height up to which the magnetic field is useful. In other words, the membrane excursion is limited, which prevents this loudspeaker from being efficient at low frequencies.

SUMMARY

The invention thus relates to an acoustic loudspeaker which conventionally comprises:

- a mobile membrane;
- a constant magnetic field source, directed along a plane substantially parallel to the membrane,
- a winding secured to the periphery of this membrane, and interacting with the magnetic field to displace the membrane when the coil conducts an A.C. current.

According to the invention, this loudspeaker is characterized in that the magnetic field source is formed of an assembly of magnetized elements arranged at the periphery of this membrane, around the winding. Each magnetized element has a cylindrical surface facing the winding. The magnetic field generated by these magnetized elements has field lines which emerge by the entire height of this internal surface from the magnetic field source.

In other words, the invention comprises forming a loudspeaker by arranging the winding on the periphery of the membrane, and by positioning the magnetic field source around the membrane, in front of the winding. The magnetic field generated by the magnetic elements arranged in a ring is thus radial and direct acts on the winding without requiring any polar element. The field lines generated by the magnets generate a homogeneous force (in terms of direction and of amplitude) on the winding, on the entire potential excursion of the membrane. Thus, the external periphery of the membrane, the coil, and the magnetic field source are located in a same plane, which provides a particularly compact and thin assembly.

Thus, unlike conventional loudspeakers which comprise polar elements or complementary magnets channeling the magnetic field, the loudspeaker according to the invention sees the magnetic field naturally close back in the surrounding environment. This apparent disadvantage is compensated by the fact that the necessary mass of magnetic material is generally significant, since it takes up the entire membrane periphery. Further, compactness gains are a highly preponderating advantage.

In practice, the shape of the membrane may be substantially planar, for example, for low-frequency applications, or of more complex shape, for a use at higher frequencies, where a greater stiffness is necessary. This shape may for example be convex, concave, or conical.

Advantageously, in practice, the different magnetized elements are arranged in a ring on the membrane periphery according to a regular angular distribution, to balance the efforts exerted on the winding.

Different geometries can be envisaged for such magnetized elements. It is thus possible to arrange substantially rectilinear elements to form a general polygonal geometry. In this case, it is also possible for the winding to be wound in a polygonal shape corresponding to the shape of the magnetic field source, to keep a substantially constant air gap. It is also possible to use magnetized elements having a curvature complementary to that of the winding, to form a source which has a generally circular shape, and which thus is at a quasi-constant distance from the winding.

Along the same line, the magnetized elements may have a surface directed towards the winding which is cylindrical, to keep a constant air gap whatever the relative position of the winding.

In practice, the magnetized elements may be assembled within successive housings formed in a frame, itself solid with a fixed point of the loudspeaker installation.

According to a feature of the invention, the loudspeaker comprises a suspension member connected on the one hand to the frame of the magnetic field source, and on the other hand to the membrane periphery. This suspension element enables to displace the membrane with respect to a fixed point.

Advantageously, the loudspeaker also comprises a second suspension member, also connected to the frame and to the membrane periphery, but on the opposite side of the winding with respect to the first suspension member, to form a closed volume around the winding. In other words, the membrane is connected to the loudspeaker frame by an assembly of two sheets defining a general volume of substantially toric shape, having the winding and the magnetic field source enclosed therein. A damp-proofing is thus ensured, in particular for the winding. The presence of the second suspension member also enables to improve the power capacity, by increasing the pull-back force applied to the moving part. This second suspension member improves the guiding of the coil by creating a deformable parallelogram structure. Further, this double suspension enables to symmetrite mechanical efforts with respect to the two motion directions of the moving part, as opposed to single-suspension systems. However, the presence of this second suspension member is not compulsory, since it adds weight to the moving part. This second suspension may thus be omitted for loudspeakers in ranges where displaced mass considerations are preponderating.

BRIEF DESCRIPTION OF THE DRAWINGS

The implementation and other features and advantages of the present invention will be discussed in detail in the following non-limiting description of embodiments in connection with the accompanying drawings.

DETAILED DESCRIPTION

Figure 1:
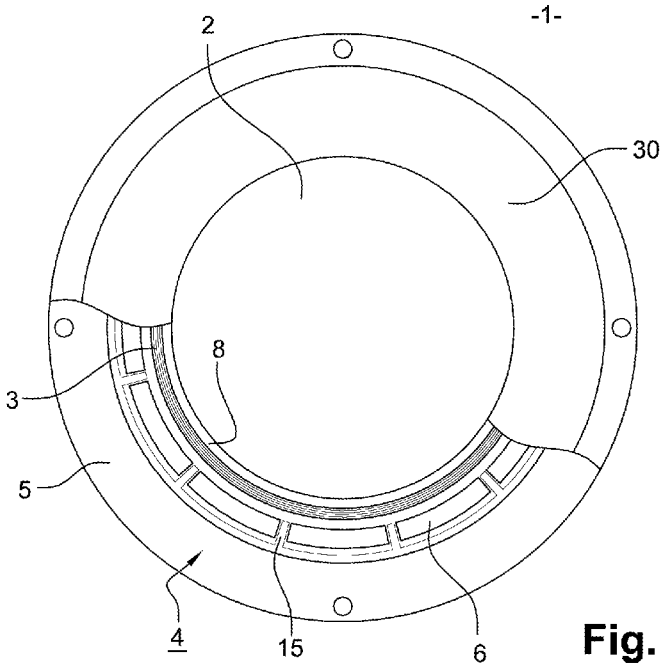
FIG. 1 is a top view of a loudspeaker according to the present invention, where a portion of one of the suspension members has been masked to expose the magnetic field source and the winding.

As already discussed, the invention thus relates to a loudspeaker which, as illustrated in FIG. 1, is essentially formed of a membrane 2 of circular shape and of substantially planar geometry. This membrane also comprises a winding 3 of circular shape which is solid attached to the membrane. Around winding 3 is magnetic field source 4, which comprises a frame 5 supporting different magnetized elements 6. More specifically, membrane 2 is conventionally formed with materials such as, for example: composite materials (combining fibers of glass, aramide or the like, or carbon), metals (especially aluminum, titanium, and beryllium), cellulose pulp, polymers such as polypropylene, polyethylene therephtalate (Mylar®), or acrylonitrile butadiene styrene (ABS), or again synthetic textiles.

The membrane shape may be planar for uses in low frequencies, or more complex (concave, convex, conical) to have a stronger stiffness, which is advantageous for operations at higher frequency.

Membrane 2 peripherally extends in an area 8 receiving winding 3, which is circularly wound around the periphery of membrane 2. The metal wire used for the winding has conventional characteristics, and is for example based on various electrically conductive materials, and especially copper, aluminum, and other alloys. The wire section may be optimized to minimize the general resistance of the coil.

Complementarily, magnetic source 4 is essentially formed of magnetized elements 6 appearing in the form of segments angularly distributed on the periphery of winding 3. In practice, elements 6 may be based on materials of very high magnetization, to compensate for the absence of polar parts and for the fact that the lines coming out of these magnetized elements 6 cross winding 3. The magnetization of elements 6 is thus selected so that it is radially oriented, and perpendicularly crosses winding 3 substantially along the plane of membrane 2. Materials such as neodyme or the like have a magnetization compatible with such applications.

Figure 4:
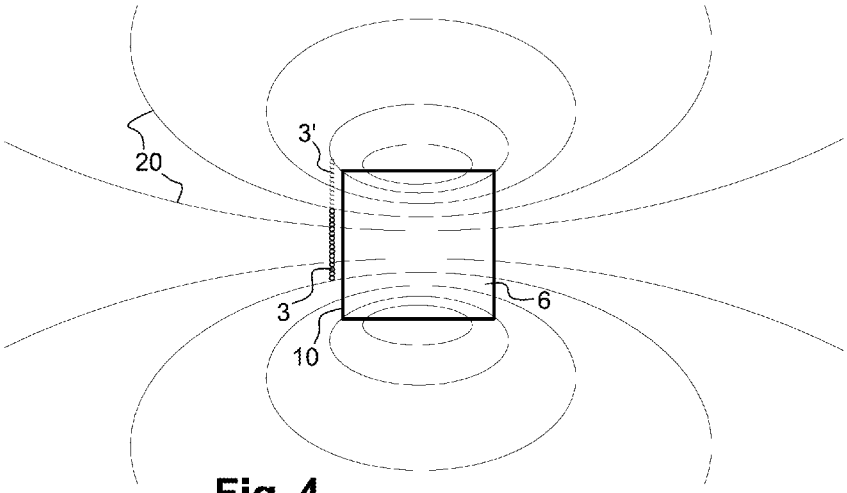
FIG. 4 is a transverse detail cross-section view of a magnet and of the opposite winding, where field lines have been shown.
Figure 3:
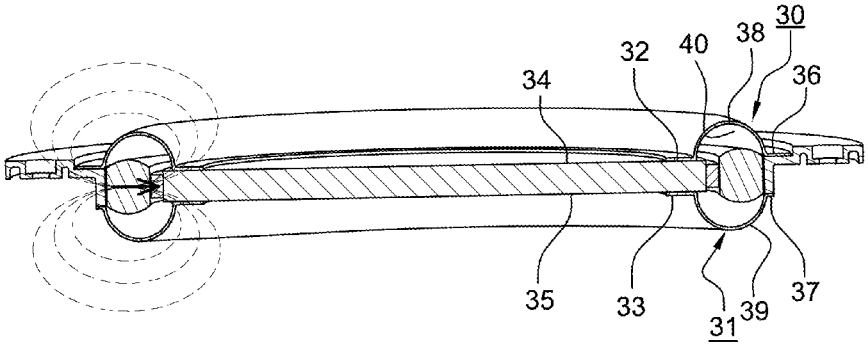
FIG. 3 is a transverse cross-section view, in slight perspective, of the loud-speaker of FIG. 1.

Different configurations may be adopted to limit the air gap and optimize the loud-speaker performance. Thus, as illustrated in FIGS. 3 and 4, each of the segments may have a surface 10 which is curved, more specifically cylindrical, to be at a constant distance from the winding. This surface is thus cylindrical, that is, the distance to winding 3 remains the same whatever the position thereof when it moves along with the membrane.

As illustrated in FIG. 4, field lines 20 emerge from planar surface 10 of the magnetized element. These field lines are directed towards the inside of the loudspeaker, towards winding 3. Thereby, during its motions, winding 3 positively undergoes the influence of the magnetic field, including in its end positions 3', one of which is illustrated by the winding in dotted lines. Along the entire height of surface 10, field lines 20 are generally directed towards the winding, with a sufficiently homogeneous distribution, which contributes to limiting distortion phenomena.

Figure 2:
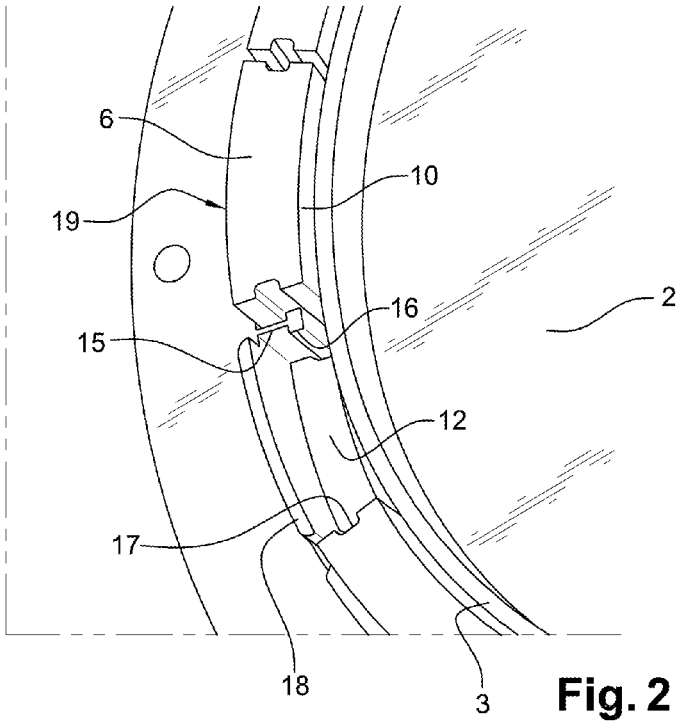
FIG. 2 is a detail view of a portion of the frame receiving the magnetized elements.

In a specific embodiment illustrated in FIG. 2, such curved magnetized elements 6 are arranged within a frame 4, which comprises appropriate housings 12. Housings 12 are formed between radial partitions 15 extending between two adjacent magnetized elements 6. Means for holding the magnetized elements may be provided, for example, in the form of a bulge 16 located at the end of partition 15, and having a shape complementary to that of a recess 17 formed on the small sides of magnetized elements 6. Similarly, a quasi-continuity of the magnetic field generated by magnetized elements 6 is kept at the border between two successive elements. Rear surface 19 of the magnetized elements may be planar or also curved, according to the type of material used. A wall 18 opposite to rear surface 19 of the magnetized elements may advantageously improve the holding of elements 6 on frame. Frame 4 has a peripheral portion enabling to attach the loudspeaker on its support.

According to a feature of the invention, the loudspeaker also comprises suspension members 30, 31 illustrated in FIG. 3. Each suspension member 30, 31 comprises an internal portion 32, 33 of substantially circular shape, and solidly attached to one of surfaces 34, 35 of membrane 2. Opposite end 36, 37 forming the external periphery of suspension member 30, 31 is itself solidly attached to frame 4 by different appropriate means such as an engagement into a groove formed for this purpose or a gluing, or any other adapted mechanical device. Portion 38, 39 of suspension member 30, 31 located between its two ends 32, 33; 36, 37 takes a curved shape, to generate a space 40 containing the magnetic field source and the winding. The shape of central portion 38, 39 is selected to allow a maximum travel of membrane 2 without generating mechanical stress. Other shapes, for example, rectangular, may also be suitable. Materials conventionally used to form the suspensions, such as coated textiles or the like, may be used.

The foregoing shows that the loudspeaker according to the invention has many advantages, and in particular that of having a particularly small thickness as compared with its diameter. It can thus be advantageously used for applications with significant bulk constraints, and this, while keeping good acoustic performances, in particular in low frequencies, due to the ability to displace a relatively significant air volume.

The invention claimed is:

1. An acoustic loudspeaker comprising:

a mobile membrane;

a constant magnetic substantially homogeneous field source substantially parallel to the membrane;

a winding secured to the periphery of said membrane, and interacting with the magnetic field to displace the membrane when it conducts an alternating current; and wherein the magnetic field source is formed of a set of magnetized elements distributed at the periphery of said membrane, around the winding, each magnetized element having a cylindrical surface opposite to the winding, the magnetic field generated by said magnetized elements having field lines emerging from said cylindrical surface along its entire height.

2. The loudspeaker of claim 1, wherein the membrane is substantially planar.

3. The loudspeaker of claim 1, wherein the membrane is concave or convex.

4. The loudspeaker of claim 1, wherein the magnetized elements are arranged in a ring on the periphery of the membrane.

5. The loudspeaker of claim 1, wherein each magnetized element has a curvature complementary to that of the winding.

6. The loudspeaker of claim 1, wherein the magnetized elements are assembled in consecutive housings formed in a frame.

7. The loudspeaker of claim 1, further comprising a suspension member connected on the one hand to the frame of the magnetic field source, and on the other hand to the periphery of the membrane.

8. The loudspeaker of claim 7, further comprising a second suspension member, also connected to the frame and to the periphery of the membrane, but on the opposite side of the winding with respect to the other suspension member, to form a closed volume around the winding.

* * * * *

UNITED STATES PATENT AND TRADEMARK OFFICE

CERTIFICATE OF CORRECTION

PATENT NO. : 9,071,898 B2
APPLICATION NO. : 13/699180
DATED : June 30, 2015
INVENTOR(S) : Arnaud Cazes Bouchet It is certified that error appears in the above-identified patent and that said Letters Patent is hereby corrected as shown below:

On the title page item (86) under § 371 (c)(1), (2), (4) Date: delete the words "Dec. 12, 2012" and replace with --Nov. 20, 2012--.

Signed and Sealed this
Twenty-sixth Day of January, 2016

Michelle K. Lee

Michelle K. Lee
*Director of the United States Patent and Trademark Office*